United States Patent [19]

Tanaka

[11] Patent Number: 4,955,133

[45] Date of Patent: Sep. 11, 1990

[54] METHOD OF MAKING PULLEYS WITH PLURAL V-SHAPED GROOVES

[75] Inventor: Haruma Tanaka, Fujimi, Japan

[73] Assignee: Sanshu Press Industry Company, Ltd., Tokyo, Japan

[21] Appl. No.: 321,859

[22] Filed: Mar. 10, 1989

Related U.S. Application Data

[62] Division of Ser. No. 198,109, May 24, 1988, abandoned.

[30] Foreign Application Priority Data

May 28, 1987 [JP] Japan ..... 130032/87

[51] Int. Cl.[5] ..... B21K 1/42

[52] U.S. Cl. ..... 29/892.3; 29/507; 29/521; 29/523; 474/169

[58] Field of Search ..... 29/159 R, 521, 507, 29/523; 474/168–171, 174

[56] References Cited

U.S. PATENT DOCUMENTS

| | | | |
|---|---|---|---|
| 183,791 | 10/1876 | Bricknell | 29/159 R |
| 1,266,579 | 5/1918 | Garcelon | 29/159 R |
| 2,846,893 | 8/1958 | Bagley | 474/169 |
| 2,846,893 | 8/1958 | Bagley | 474/174 |
| 3,245,273 | 4/1966 | Loper et al. | 29/159 R |
| 3,467,180 | 9/1969 | Pensotti | 29/523 |
| 3,722,309 | 3/1973 | Shaffer | 474/169 |
| 3,838,485 | 10/1974 | Oldford | 474/170 |
| 3,838,485 | 10/1974 | Oldford | 474/170 |
| 3,994,181 | 11/1976 | Sproul | 474/170 |
| 4,098,137 | 7/1978 | Yaros | 474/170 |

FOREIGN PATENT DOCUMENTS

| | | | |
|---|---|---|---|
| 870667 | 6/1961 | United Kingdom | 474/169 |
| 2059838 | 4/1981 | United Kingdom | 29/521 |

*Primary Examiner*—P.W. Echols

*Attorney, Agent, or Firm*—Mason, Fenwick & Lawrence

[57] ABSTRACT

A method of making a pulley with a number of V-shaped grooves, especially having a stepped shape, comprises a rim or rims and a core which are separately formed by an appropriate plastic process and are fixed or connected fixedly to each other by a metallurgical or mechanical processing. According to one embodiment, a short pipe-shaped blank is rolled to produce a rim with a number of V-shaped grooves, and thereafter the rim or rims is fixed to a core by the action of the rolling to interfit serrations on the rim and core.

1 Claim, 11 Drawing Sheets

FIG.15(a)
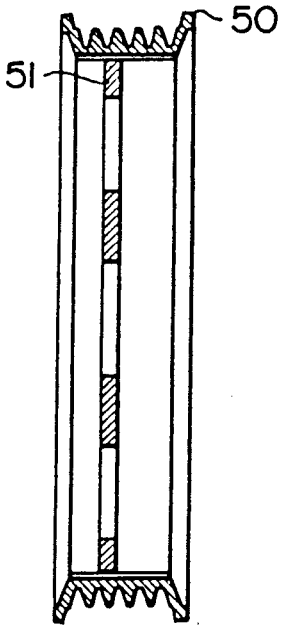
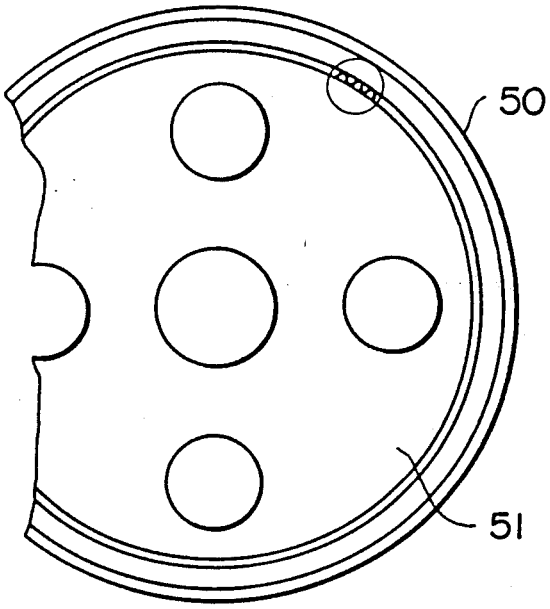
FIG.15(b)
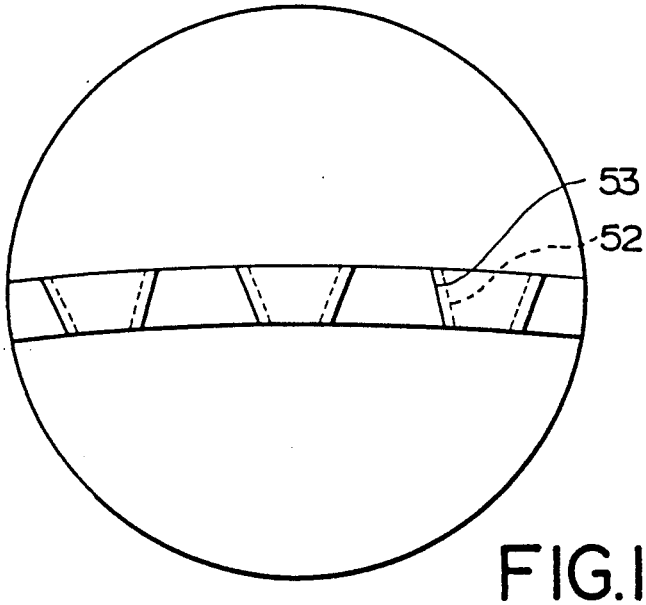
FIG.15(c)

10
3

60
3
2
1

25
60

METHOD OF MAKING PULLEYS WITH PLURAL V-SHAPED GROOVES

This is a divisional application of prior application Ser. No. 198,109 filed on 5/24/88 entitled Method of Making Pulleys with Plural V-shaped Grooves, now abandoned.

FIELD AND BACKGROUND OF THE INVENTION

The present invention relates in general to provide a pulley with a number of V-shaped grooves and a method of making this pulley.

The pulley with a number of V-shaped grooves is used for transmitting mechanical power and previously has been manufactured by cutting. Recently it has been proposed to manufacture this pulley by plastic processing or rolling (for example, Japanese Patent Kokai No. 188657/85 and Japanese Patent Kokai No. 88936/86), and the plastic processing or rolling is widely used today.

However, it is difficult for pulleys provided with a number of V-shaped grooves to obtain a sufficiently wide variety of desired shapes because of working condition difficulties, and the utilizable range of the pulley is limited because the cost of dies for making it and other costs are high. Pulleys made with a stepped shape by metal cutting are especially costly.

SUMMARY OF THE INVENTION

An object of the invention is to provide a pulley with a number of V-shaped grooves and a method of making this pulley wherein a rim or rims and the core are separately processed and thereafter fixed or connected fixedly to each other easily.

Another object of the invention is to provide a pulley with a number of V-shaped grooves and a method of making this pulley wherein the limitation in shape is removed and the grooved region is greatly enlarged.

According to the invention, there is provided a method of making a pulley with a number of V-shaped grooves, in which pulley a rim or rims are fixed to a core, comprising rolling a short pipe-shaped blank or such blanks for the rim or rims in order to form the rim or rims provided with a number of V-shaped grooves, punching or squeezing a blank for the core in order to form the core, and fixing the rim or rims to the core by means of metallurgical or mechanical means.

Moreover, there is provided a method of making a pulley with a number of V-shaped grooves, in which pulley a rim or rims are fixed to a core, comprising preparing a short pipe-shaped blank or such blanks for the rim or rims, punching or squeezing a blank for the core in order to form the core, rolling the blank or blanks for the rim or rims in order to form the rim or rims provided with a number of V-shaped grooves, and, simultaneously with said rolling, fixing the rim or rims to the core by the action of said rolling.

In addition, there is provided a method of making a pulley with a number of V-shaped grooves, in which pulley a rim or rims are fixed to a core, comprising rolling a short pipe-shaped blank or such blanks for the rim or rims in order to form the rim or rims provided with a number of V-shaped grooves, punching or squeezing a blank for the core in order to form the core, and enlarging the core in order to fix the rim or rims to the core.

The invention also provides a pulley with a number of V-shaped grooves comprising a rim or rims and a core, the rim or rims being provided with a number of V-shaped grooves and formed by rolling of a short pipe-shaped blank or such blanks for the rim or rims, the core being formed by punching or squeezing a blank for the core, and said rim or rims and said core being fixed to each other by means of metallurgical or mechanical means.

According to the invention, the rim or rims and the core are separately formed by plastic processing and they are fixed to or connected fixedly to each other by means of metallurgical or mechanical means, so that the pulley is easily and reliably manufactured, any desired shape is adoptable, and its grooved region is enlarged.

For a better understanding of the invention, its operating advantages and its specific objects attained by its uses, reference is made to accompanying drawings and descriptive matter in which preferred embodiments of the invention are illustrated.

BRIEF DESCRIPTION OF THE DRAWINGS

In the Drawings:

FIG. 15 (*a*) and FIG. 15 (*b*) are sectional view and front view, respectively, of the pulley manufactured according to an embodiment of the invention;

FIG. 15 (*c*) is an enlarged detailed view of the portion shown in the small circle in FIG. 15(*b*).

DESCRIPTION OF THE PREFERED EMBODIMENTS

Figure 1:
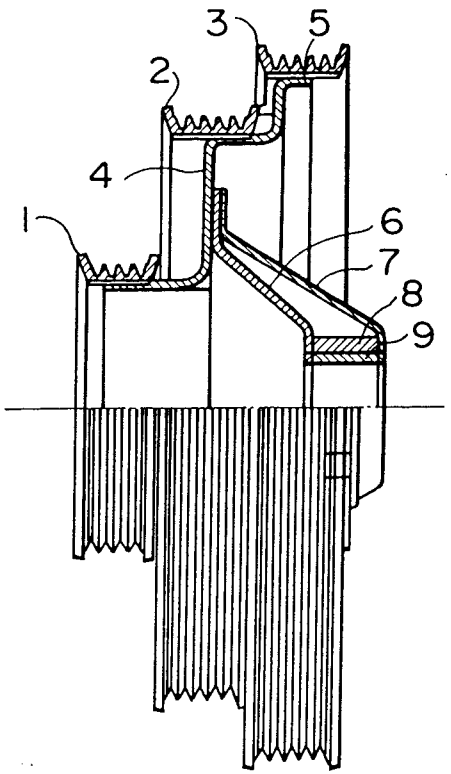
FIG. 1 is a side view with a partial section showing the pulley manufactured according to the invention.

FIG. 1 shows an embodiment of the pulley produced according to the invention, said pulley having a number of V-shaped grooves. The pulley has rims 1, 2 and 3 each of which is formed with a number of V-shaped grooves and are fixed or connected fixedly to the outer periphery of a unitary, one piece core 4 produced by squeezing, said core 4 being, for example, shaped as a short stepped drum with open ends. To the core 4 are fixed reinforcers or supporters 6, 7, 8 and 9 by bolting, riveting, spot-welding or the like.

The reinforcers 6, 7, 8, 9 may be produced by machining of castings or forgings, but this point does not relate to the invention directly so that the detailed description of it is omitted.

Each of the rims 1, 2, 3 is produced by rolling according the above identified Japanese Patent to Kokai, which rolling has advantages that articles with different diameters can be produced by means of one and the same machine and a small number of dies are required. Moreover, the core 4 is simple in shape so that the cost of dies for making it is cheap and it is easily produced with low cost. Accordingly, the total cost for making the pulley by the method according to the invention is cheaper than the cost for making it by machining.

Figure 2:
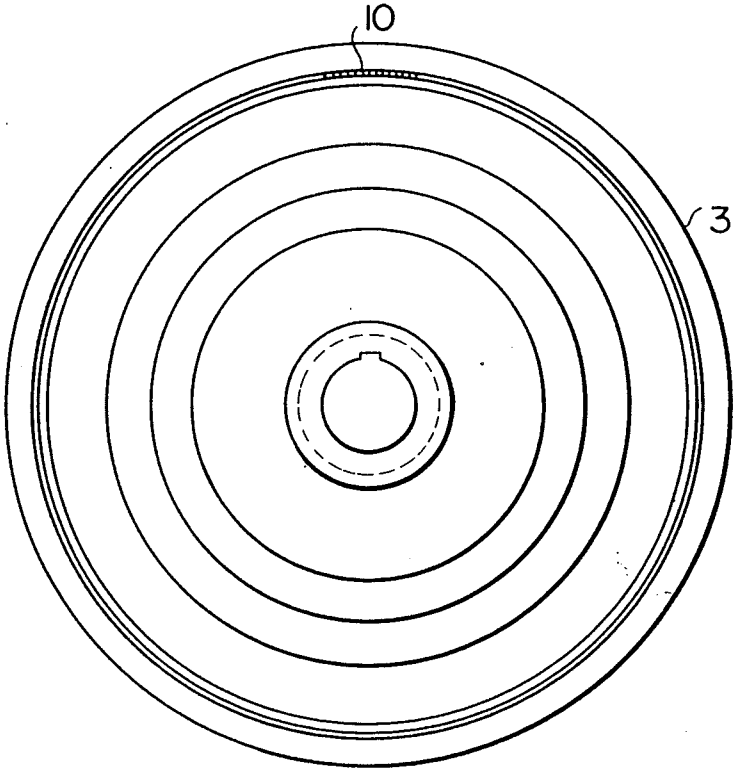
FIG. 2 is an elevational view of the pulley viewed from the right of FIG. 1.

As shown in FIG. 2, the inner surface of each of the rims 1, 2 and 3 is formed with serrations 10 which engage with serrations on the cylindrical outer surface of the core 4 in order to greatly increase the fixation force between the rim 1, 2, 3 and the core 4 in the direction of rotation. These serrations 10 of the rims 1, 2, 3 are originally used for improving the accuracy of the V-shaped grooves, but these are used for the fixation between the rims 1, 2, 3 and the core 4 according to the invention. The pulley is a member for transmitting a rotation, so that axial force applied to it is small. Therefore, it is sufficient to achieve the fixation by several spot weldings along the circumference after the rims 1, 2, 3 are engaged with the core 4.

It is easily able to be grasped from the above embodiment of the pulley according to the invention that the pulley having any shape can be easily produced if the rims 1, 2, 3 and core 4 are made separately and thereafter these are combined. Accordingly, the pulley with a number of V-shaped grooves is easily produced, and for example the combination of the magnetic clutch yoke with the pulley provided with a number of V-shaped grooves is easily achieved.

Hereinafter, the manufacturing of the pulley according to the invention using plastic processing alone is described. The manufacturing of the core 4 uses a general press processing (punching or squeezing) and therefore the explanation of it is not required. Accordingly, hereinafter the processing for rims 1, 2, 3 and the fixation of the rims 1, 2, 3 to the core 4 is mainly explained.

(I) Preliminary processing:

To make the rim 1, 2 or 3, in general, a short pipe cut from a long pipe is rolled to make V-shaped grooves on its outer periphery. But, to make the short pipe according to the invention, it is ordinary that a flat plate is curved and thereafter welded to make the short pipe.

This method is shown in FIGS. 3–7.

Figure 3:
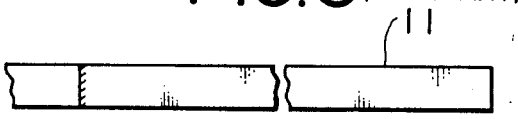
FIG. 3 (PRIOR ART)
FIGS. 3 through 7 are side views or front views showing the process for making a short pipe from a flat plate.
Figure 4:
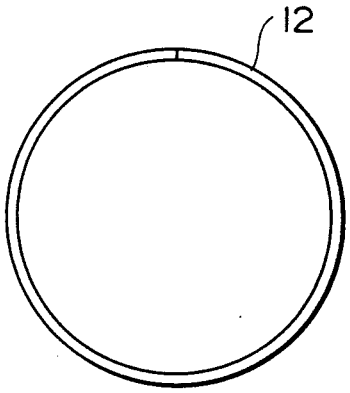
FIG. 4 (PRIOR ART)
Figure 5:
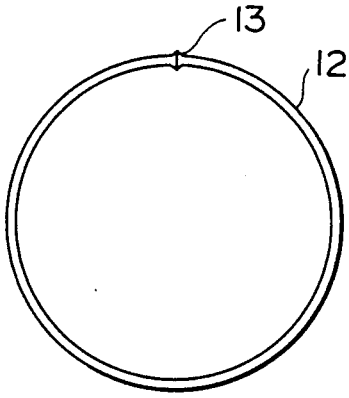
FIG. 5 (PRIOR ART)
Figure 6:
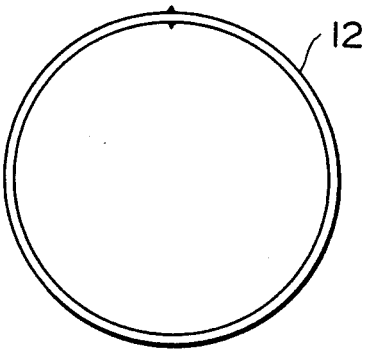
FIG. 6 (PRIOR ART)
Figure 7:
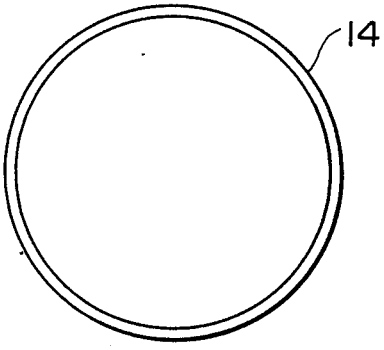
FIG. 7 (PRIOR ART)

First, a flat plate 11 is cut into a predetermined length as shown in FIG. 3, and this cut flat plate 11 is curved into a short pipe-shaped band 12 as shown in FIG. 4. Thereafter both ends of the pipe-shaped band 12 are welded to each other for example by upset butt welding to connect these ends to each other as shown in FIG. 5. Next, removing of burr 13 is carried out (FIG. 6). Then, the surfaces in the connection area are finished as shown in FIG. 7 to obtain a narrow band or short pipe 14. The cost for this processing is much lower in case of mass production than that for previous pipe-cutting processing.

This processing is one method for making a short pipe. Another processing is known wherein a plate is spirally wound and welded. Accordingly, the above processes are well-known but explained as the first process for manufacturing the rims 1, 2, 3 of the pulley with V-shaped grooves.

(II) Forming of V-shaped grooves:

The outer periphery of thus formed short pipe 14 is, in order to form with V-shaped grooves, rolled by means of a roll having an outer shape corresponding to the V-shaped grooves.

There are two rolling processes. One of them is to directly roll the said short pipe 14, and the other of them includes a preliminary forming wherein flanges at both ends of the short pipe 14 are projected before the rolling.

Figure 8:
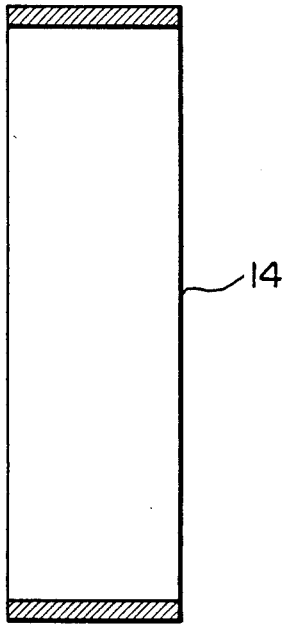
FIGS. 8 and 9 are sectional views showing a process for producing a rim with a number of V-shaped grooves.
Figure 9:
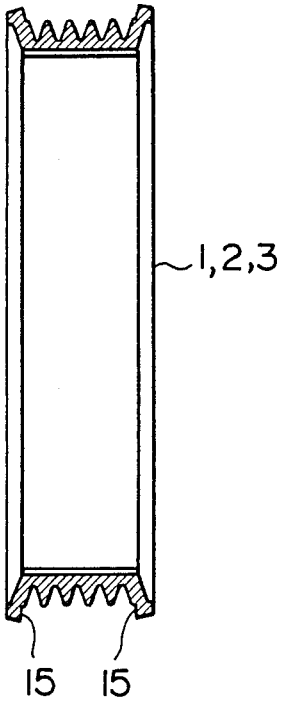

(II-a) Rolling process, No. 1:

FIG. 8 shows the short pipe 14 before processing. The outer diameter of this pipe 14 is nearly equal to that of flanges 15 at both ends of the formed rim 1, 2, 3, but the rolling reduces the outer diameter of the center portion of the pipe 14 as shown in FIG. 9. This process is substantially the same to the prior art process disclosed in above identified Japanese Patent Kokai.

Figure 10:
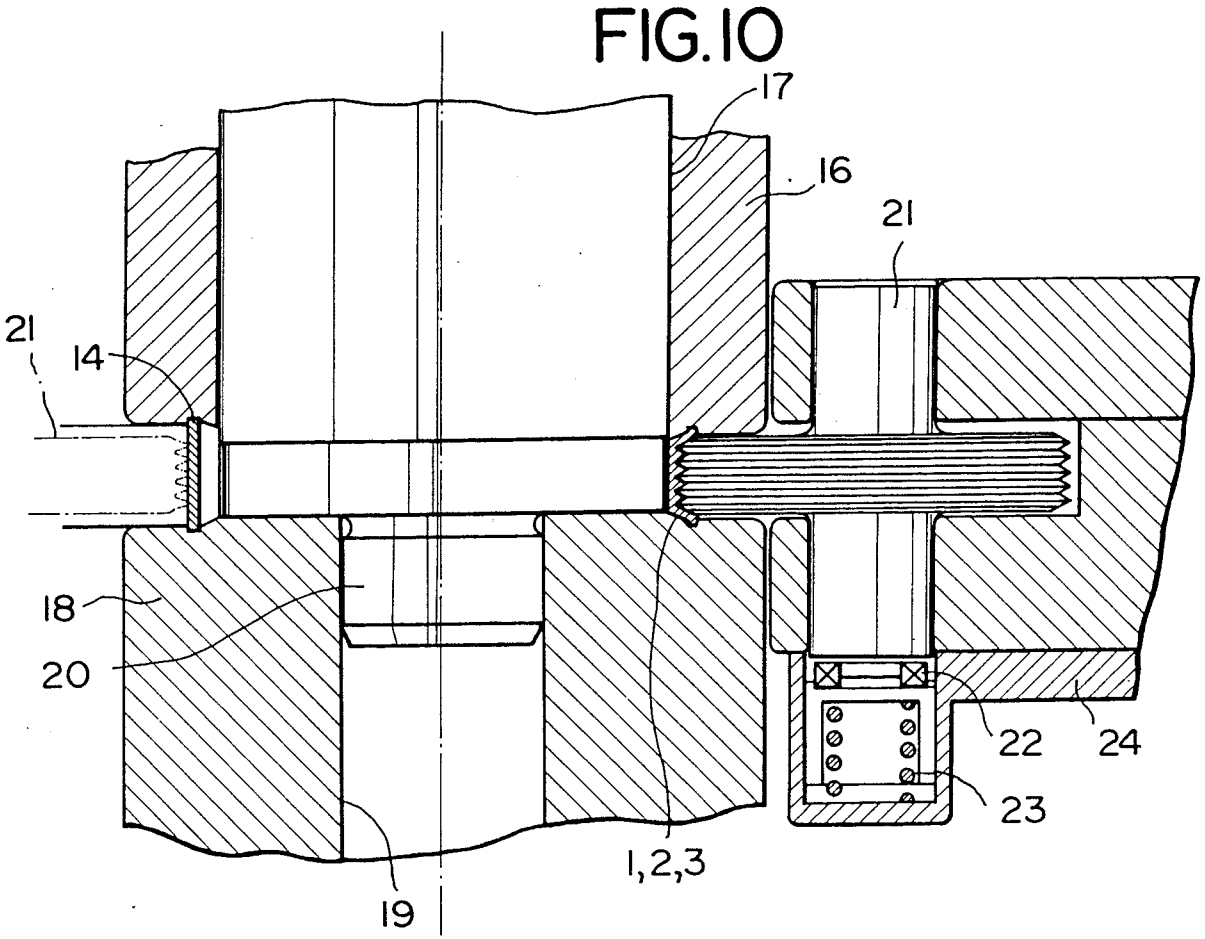
FIG. 10 is a sectional view of an apparatus for carrying out the process of FIGS. 8 and 9.

FIG. 10 shows the apparatus for carrying out this process and explains its function. The left half illustrates the state before the rolling starts, and the right half the state after the processing is completed. Above the short pipe 14 which is in the form of a blank, there is arranged an upper pressing die 16 which is disposed so that it is vertically movable while guided by a core die 17 positioned inside of the pressing die 16. A lower die 18 has a center hole 19 for guiding a projection 20 projected from the core die 17 so that the core die 17 is exactly held at the center of the apparatus.

In the processing, the blank 14 is positioned on the lower die 18. Thereafter, the pressing die 16 and core die 17, which are previously moved upward, are lowered, the core die 17 is brought into contact with the lower die 18, and thereafter the pressing die 16 presses the blank 14 with a predetermined pressure. Then these dies 16, 17 and 18 are rotated together with the blank 14 to prepare the rolling processing.

In the rolling processing wherein a roll 21 is pushed toward the blank 14, the vertical position of the roll 21 at the start of the processing and that at the end of the processing are different from each other. Accordingly, means for making the roll 21 vertically movable is required, which comprises a thrust bearing 22, a spring 23 and a spring chamber 24. They cause the roll 21 to be pushed up.

Before the rolling, the roll 21 is pushed up and held in a predetermined position. The adjustment of this position is carried out, for example, by vertical movement of the whole roll assembly. Accordingly, before the rolling the roll 21 is in its elevated position as shown in the left half of FIG. 10, and during the rolling processing the roll 21 is advanced along the center axis of the blank 14 while moved downward.

After the processing the roll 21 is retreated, and thereafter the core die 17 is moved upward while holding the pressing die 16 in its position. Thus, the formed blank shaped to provide the rim 1, 2, 3 is able to be removed.

This process has an advantage that the short pipe can be directly processed without auxiliary processing so that the number of processing steps is small.

Figure 11:
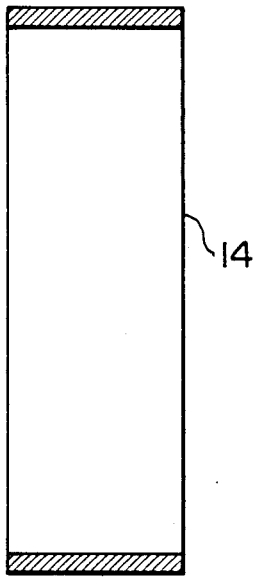
FIGS. 11 through 13 are sectional views showing another process for producing a rim with a number of V-shaped grooves.
Figure 12:
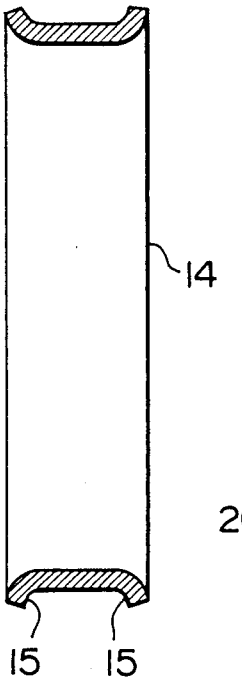
Figure 13:
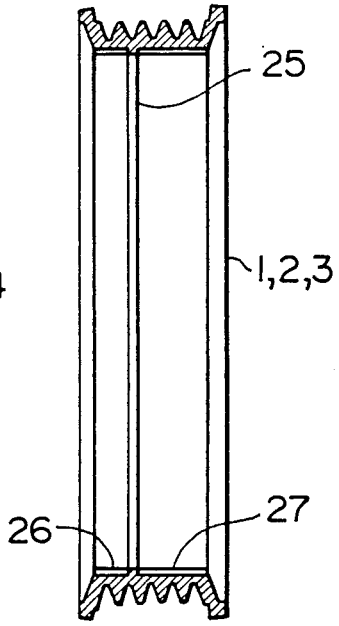

(II-b) Rolling process, No. 2:

In this process, the V-grooves are formed by rolling after the flange is projected at both ends of the short pipe 14. This process is shown in FIGS. 11–13. In this case, the diameter of the short pipe 14 is smaller than that in the above process (II-a).

According to this process, the formed rim 1, 2, 3 can be provided with a ring-shaped inner protrusion 25 as shown in FIG. 13. In the rim 1, 2, 3 shown in this FIG. 13, its inner periphery surface has serrated regions 26, 27 on both sides of the protrusion 25 and has no serrations in the protrusion 25. Such a shape is very useful for the mechanical fixation between the rims 1, 2, 3 and the core 4 as hereinafter described.

Figure 14:
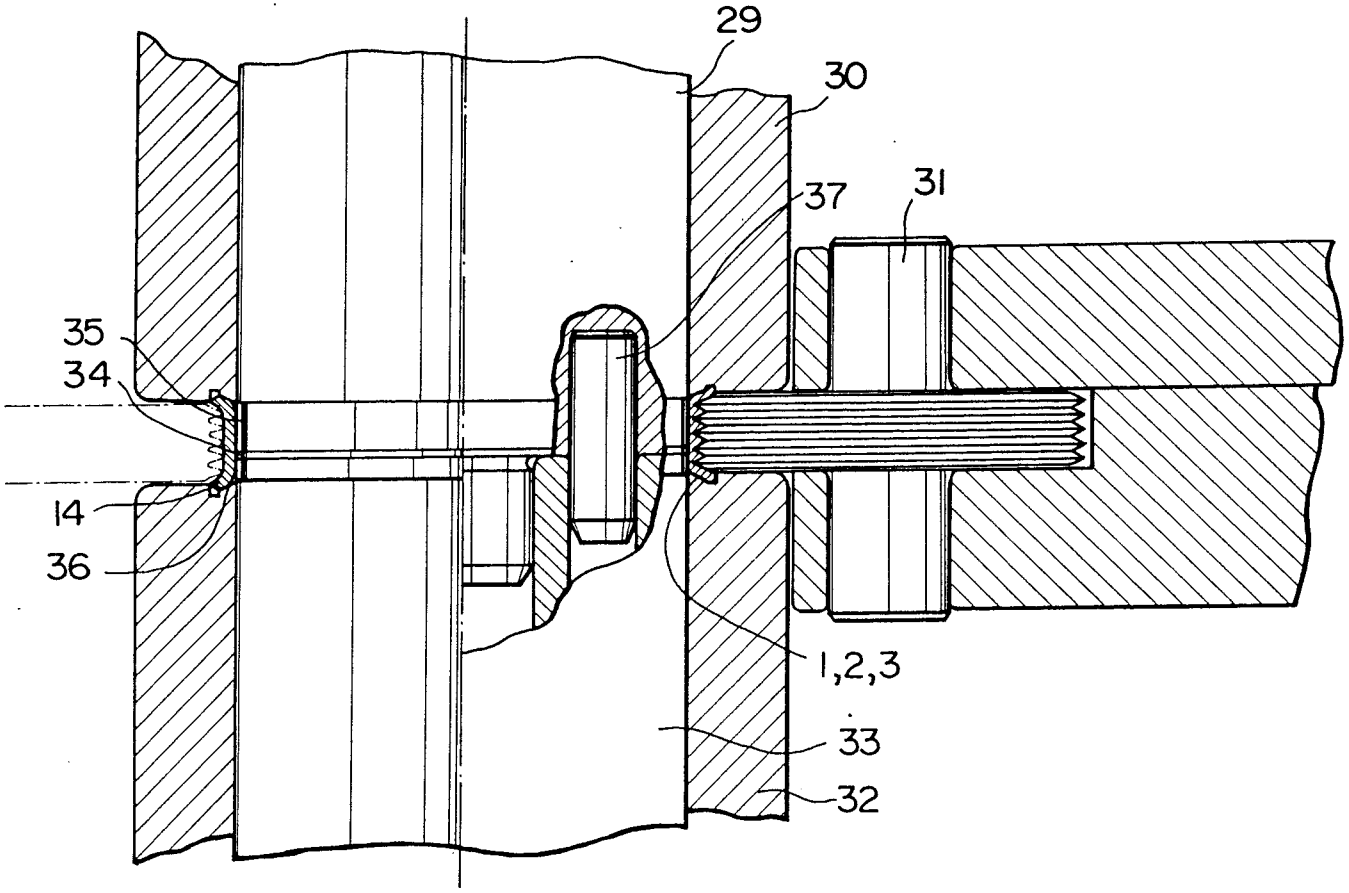
FIG. 14 is a sectional view of an apparatus for carrying out the process of FIGS. 11 through 13.

The apparatus used for this rolling process and its function are shown in FIG. 14. The functions of a core die 29 and an upper pressing die 30 shown in FIG. 14 are similar to those of the core die 17 and upper pressing die 16 shown in FIG. 10, but there is a large difference that no downward movement of the pressing die 29 is required during the rolling in FIG. 14, since the breadth of the blank 14 before the rolling is nearly equal to that of the rim 1, 2, 3 after the rolling in FIG. 14. Accordingly, there is used a roll 31 held in a position, and no spring such as the spring 23 in FIG. 10 is required.

In the lower region of the apparatus, there are arranged a lower die 32 and a lower core die 33 which are so positioned that a ring-shaped groove 34 is formed between the core die 29 and the lower core die 33. The core die 29 and the lower core die 33 are formed on their outer peripheries with serrations 35 and 36 respectively.

A numéral 37 indicates a positioning pin used for positioning the serrations 35 and 36, but in many cases no positioning pin is required.

In the processing, the roll 31 is advanced toward the axis of the blank 14 while the dies 30, 32 etc. are rotated together with the blank 14 so that the rim 1, 2, 3 is formed as shown in the right half of FIG. 14.

(III) Fixation between the rim and the core:

Hereinafter, the mechanical fixation between the rim and the core is explained. This process is divided into two, one of them is single-rim process and the other of them is plurality-rim process.

(III-a) Single-rim-process:

Developing the process according to FIG. 14, a rim 50 can be fixed to a core 51 which is formed as a disc in this case, as shown in FIG. 15.

This process is to fix the rim 50 to the disc 51 during the rolling for forming the V-shaped grooves. According to this process, the fixation strength is strong and reliable. Describing the process in detail, the outer periphery of the disc 51 is formed with serrations as indicated by a dotted line 52, and, since the widths of grooves in the rim serrations 53 are smaller than the widths of projections in the disc serrations 52, the disc 51 is fixed to the rim 50 along the outer periphery as well as in the axial direction.

Figure 16:
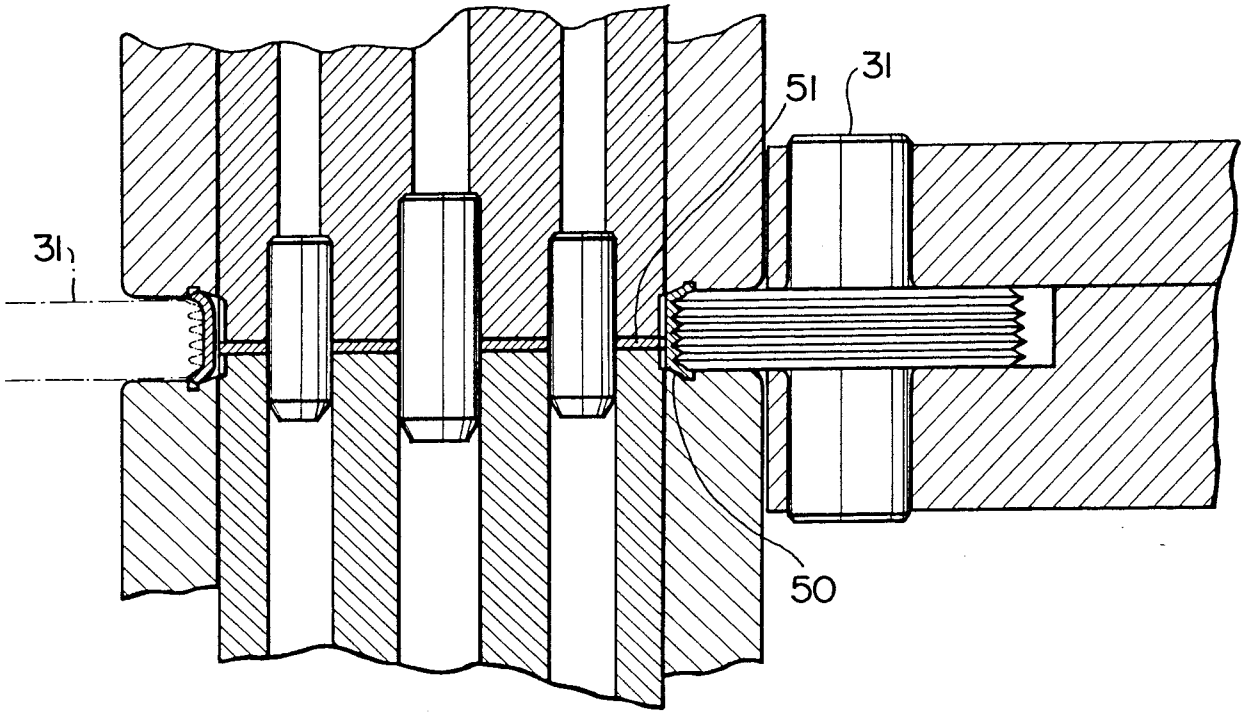
FIG. 16 is a sectional view of an apparatus for carrying out the manufacturing method according to FIG. 15 (*a*)–(*c*)

This processing is nearly identical with that shown in FIG. 14, but is shown in greater detail in FIG. 16 in order to clarify the difference from that shown in FIG. 14. The difference is that the disc 51 is positioned in the groove 34. Further discription is omitted.

Figure 17:
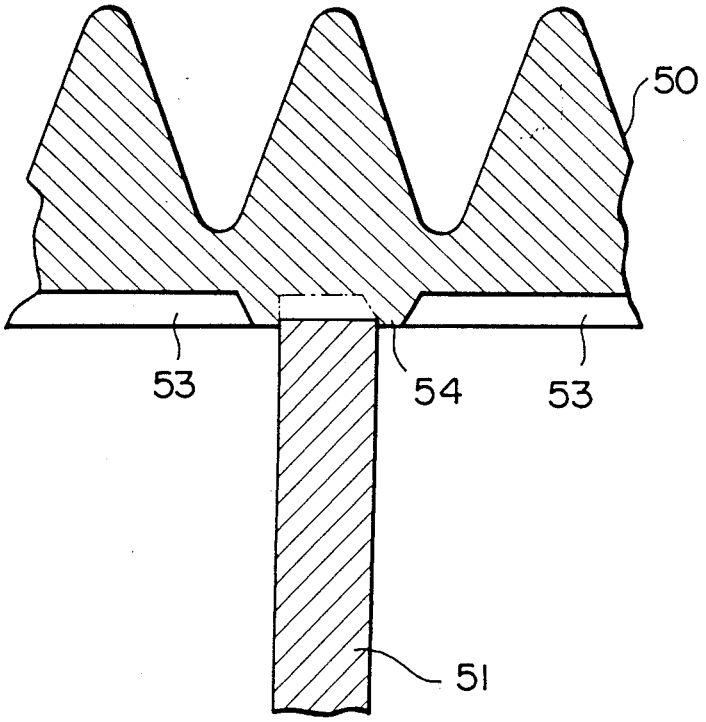
FIG. 17 is a partially enlarged sectional view of the pulley manufactured according to the variation of the manufacturing method of FIG. 15 (*a*)–(*c*)

The single-rim process can also employ rim-to-disc fixation as shown in FIG. 17. FIG. 15 shows a pulley in which the widths of projections in the disc serrations are greater than the widths of grooves in the rim serration, but the pulley shown in FIG. 17 is different from that shown in FIG. 15 in that portions 54 which have no serration are formed on both sides of the disc 51. According to this construction, the fixation strength in the axial direction is increased and the shape and size of the serrations on the outer periphery of the disc can be selected freely so that an advantageous design can be obtained.

This process is mainly adopted for a single pulley, and this single pulley prepared by this process is lighter and lower in cost than that made from one plate. Such advantages are demonstrated in case that many kinds are produced in small quantities.

Figure 18:
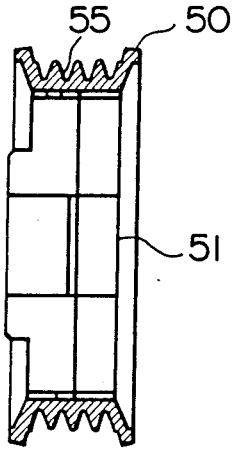
FIG. 18 is a sectional view showing another variation.

FIG. 18 shows a pulley in which a rim 50 is connected to a disc 51 made by machining, where a part of the rim 50 is engaged into the grooves in the serration section of the disc 51. Such a fixation process is widely usable, for example, for fixing the rim to a disc formed from a plate or to the outer periphery of a magnetic clutch yoke because the shape can be very freely designed. Additionally, it is possible to use high-tension steel plate for the disc in order to provide additional strength.

(III-b) Plural-rim process:

The process for mechanically fixing between the rims 1, 2, 3 and the core 4 formed by squeezing is explained hereinafter.

It is preferred to make the rims and the core separately in order to manufacture the pulley with a number of rims as described before, but there is a problem in the fixation between them. FIGS. 1 and 2 show the fixation by welding, and this fixation is sufficiently practical today because of the advancement of the welding machine, but it requires somewhat higher cost.

Figures 19A, 19B, 19C:
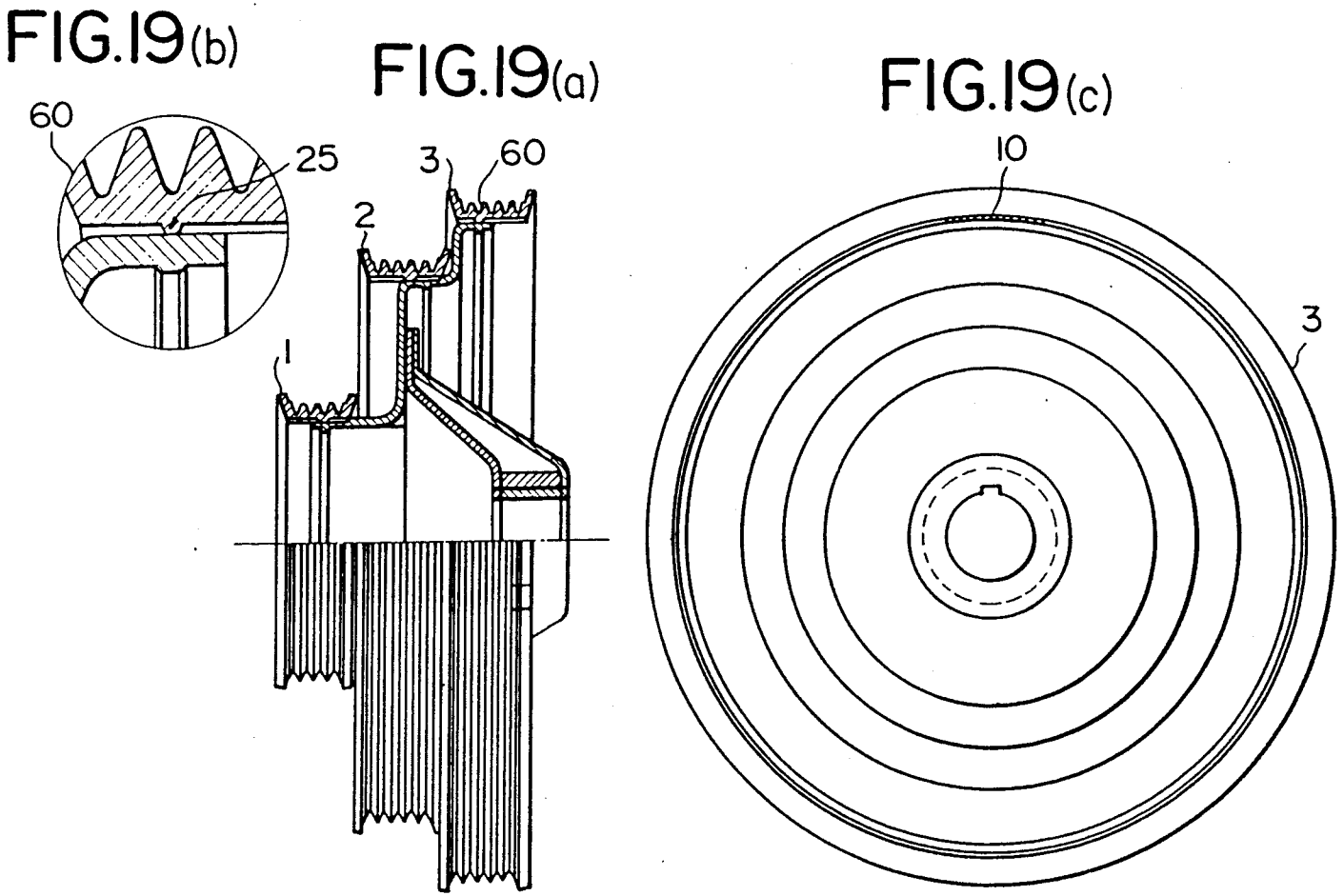
FIG. 19 is a partial sectional view and a front view showing the pulley manufactured according to another embodiment of the invention.

FIG. 19 shows a mechanical fixation. In order to form this fixation, it is necessary to make the rim 1, 2, 3 as shown in FIG. 13, and the fixation region including the protrusion 25 is indicated by a numeral 60. Such a fixation can resist the forces in the rotational and axial directions.

Figure 20:
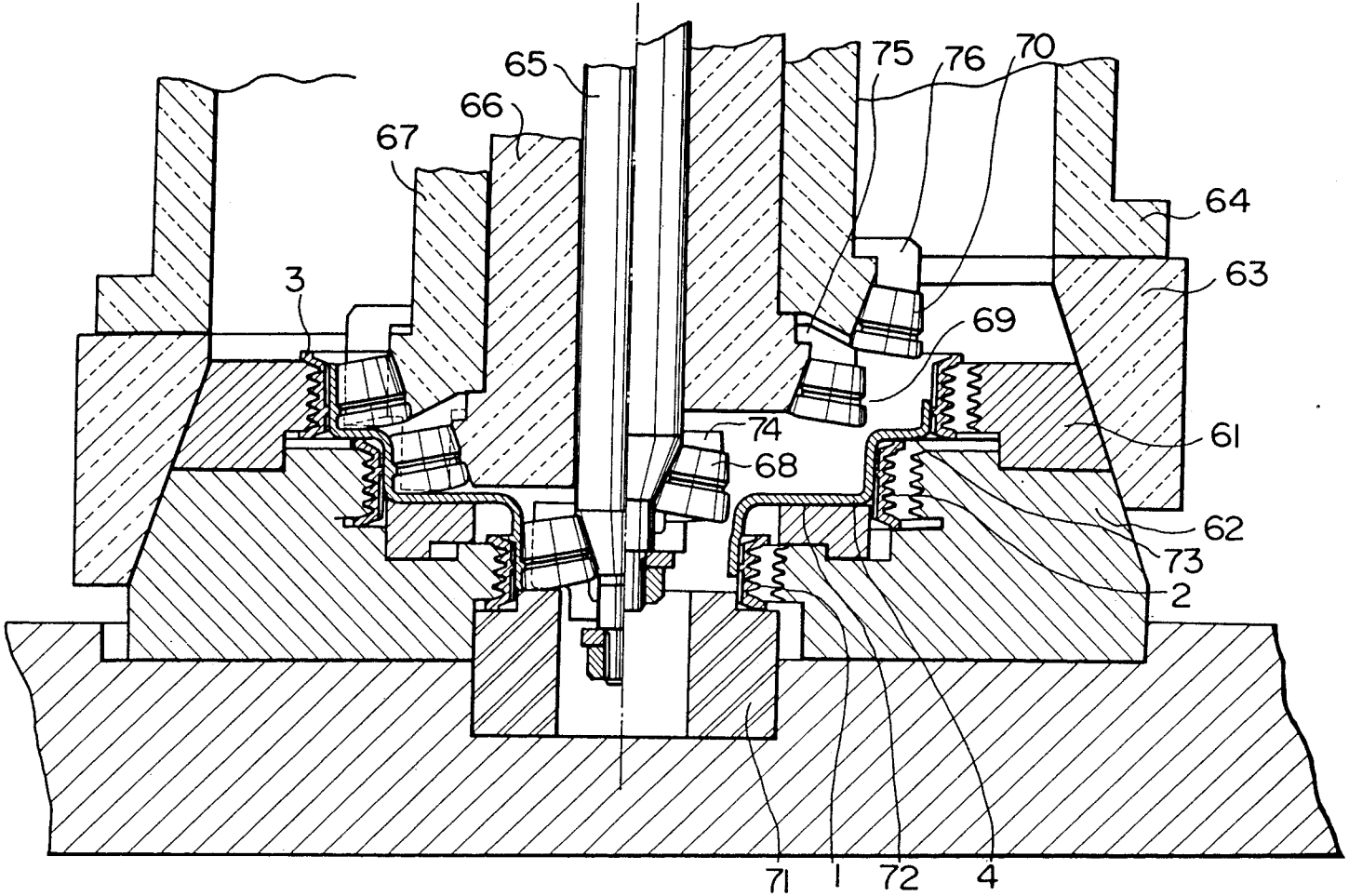
FIG. 20 is a sectional view showing the apparatus for making the pulley according to FIG. 19.

FIG. 20 shows the dies in the apparatus for carrying out this process. The core 4 has outer diameters corresponding to inner diameters of the rims 1, 2, 3, that is, the diameters at the projection tips in the serrations in the rims 1, 2, 3. The rims 1, 2, 3 are arranged within split dies 61 and 62 as shown in the right half of FIG. 20, and then a tapering die 63 is pushed down by means of a pusher 64 so that the split dies 61, 62 are closed as shown in the left half of FIG. 20.

The diameters at the projection tips in the V-grooves of the split dies 61, 62 are exactly predetermined.

Then, rotary shafts 65, 66, 67 are pushed down so that lower ends of taper rollers 68, 69, 70 mounted on the rotary shafts 65, 66, 67 are brought into contact with a supporting die 71, a first flat portion 72 of the core 4 and a second flat portion 73 of the core 4 respectively. Thereafter, the rotary shafts 65, 66, 67 are further lowered while rotated about their common axis, so that the diameters of the rotary motions of the taper rollers 68, 69, 70 about the common axis of the shafts 65, 66, 67 are progressively increased in order to achieve an enlargement processing of the inner surface of the core 4. In this time, the outer diameters of the core 4 are pushed against the inner diameters of the rims 1, 2, 3, and, if said diameter of the rotary motions of the taper rollers 68, 69, 70 is further increased, then the outer surfaces of the core 4 are intruded into the grooves of the serrations in the inner surfaces of the rims 1, 2, 3 in order to complete the fixation.

It is required in order to achieve such a process that the rims 1, 2, 3 are harder than the core 4, and in actual practice wherein an iron plate is used as a blank for the rim, the rim has a higher working hardness than the core and the process is able to be realized.

In case more reliability is required, the outer peripheries of the core 4 may be formed with serrations corresponding to those of rims 1, 2, 3. The design of the taper rollers 68, 69, 70 is able to be changed; for example, these may be supported by roller holders 74, 75, 76.

The process shown in FIG. 20 is one embodiment for carrying the invention, and many other processes can be adopted for enlarging the core in order to fix the rims to this core. An absolute requirement is that the split dies having the V-shaped grooves corresponding to the V-shaped grooves of the rims are pushed inward to shape the rims into a predetermined size. Especially, in case of high-speed rotation preliminary pressing is required to overcome the centrifugal force, so that the diameters of the rims before the fixation should be greater than that after fixation. The fixation as above-mentioned has a higher production speed than the welding fixation, is adapted to mass production, and possesses a high accuracy.

The invention is closely connected to the art disclosed in above Japanese Patent Kokai, and mainly uses the serrations on the inner surface of the rim. These serrations are originally employed for improving the accuracy of the V-shaped grooves, but the characteristic of the invention is to use these serrations for fixation.

While specific embodiments of the invention have been shown and described in detail to illustrate the application of the principles of the invention, it will be understood that the invention may be embodied otherwise without departing from such principles.

What is claims is:

1. A method of making a pulley with a plurality of V-shaped grooves, wherein the pulley has a rim including one or more rim formations fixed to a core, comprising the steps of (a) punching a core blank to form a core member having a selected core shape including a generally cylindrical outer surface having serrations facing outwardly therefrom, (b) processing a rim blank having a smooth outer surface and inner surface to form a rim member having a rim formation formed therein, wherein the rim formation has an inner surface including rim serrations and an outer surface, (c) rolling a roll against the rim formation to form a plurality of outwardly facing V-shaped grooves on the outer surface of the rim formation; and (d) simultaneously with said rolling step, fixing the rim member to the core member by interfitting the serrations on the core member with the rim serrations of the rim formation under the action of the force used in said rolling step.

* * * * *